United States Patent [19]

Matsumura et al.

[11] 3,993,719

[45] Nov. 23, 1976

[54] PROCESS FOR PRODUCING CARBON FIBERS

[75] Inventors: Yasuo Matsumura; Soichiro Kishimoto; Masahiko Ozaki, all of Okayama, Japan

[73] Assignee: Japan Exlan Company Limited, Osaka, Japan

[22] Filed: Jan. 31, 1975

[21] Appl. No.: 546,178

[30] Foreign Application Priority Data

Feb. 15, 1974 Japan ..... 49-18266

[52] U.S. Cl. ..... 264/29.1; 264/DIG. 19; 423/447.1

[51] Int. Cl.[2] ..... C01B 31/07

[58] Field of Search ..... 264/182, 29, DIG. 19; 423/447

[56] References Cited

UNITED STATES PATENTS

| | | | |
|---|---|---|---|
| 3,180,913 | 4/1965 | Veitch et al. | 264/182 |
| 3,330,898 | 7/1967 | Harley et al. | 264/182 |
| 3,701,820 | 10/1972 | Kuratani et al. | 264/182 |
| 3,784,666 | 1/1974 | Sekiguchi et al. | 264/182 |
| 3,841,079 | 10/1974 | Ram et al. | 264/29 |

FOREIGN PATENTS OR APPLICATIONS

| | | | |
|---|---|---|---|
| 47-22664 | 6/1972 | Japan | 423/447 |
| 47-24185 | 7/1972 | Japan | 264/29 |
| 48-7889 | 3/1973 | Japan | 264/29 |
| 47-40574 | 10/1972 | Japan | 423/447 |
| 1,009,760 | 7/1962 | United Kingdom | 264/182 |

OTHER PUBLICATIONS

Kirk–Othmer's Encyclo. of Chem. Tech. p. 317, 1963.

*Primary Examiner*—Jay H. Woo
*Attorney, Agent, or Firm*—Wenderoth, Lind & Ponack

[57] ABSTRACT

Improved carbon fibers (including graphite fibers) are produced by drying acrylic fibers in a water-swollen state spun from an inorganic solvent solution of an acrylonitrile homopolymer or copolymer containing at least 85 mol % acrylonitrile and having an orientation degree of at least 50% and a water content of 5 to 150%. The drying step is carried out at a temperature below 70° C to reduce the water content in said fibers to below 4%. The dried fibers are then heated to form the improved carbon fibers.

14 Claims, No Drawings

PROCESS FOR PRODUCING CARBON FIBERS

This invention relates to an improved process for producing carbon fibers (including graphite fibers) from acrylic fibers.

It is already known that, when an acrylonitrile homopolymer or copolymer fiber is heated or fired, there will be caused a cyclization reaction so that the fiber is thermally stabilized. When it is further heated at a higher temperature, it will become a carbonaceous body. Many suggestions have been made on the process for producing carbon fibers. For example, there is generally practiced such process for obtaining carbon fibers by first heating acrylic fibers at a temperature below 400° C. in an oxidizing atmosphere so as to be thermally stabilized, then carbonizing them at a temperature above 800° C. in a non-oxidizing atmosphere and lastly further elevating the temperature to be above 2000° C. so that the fibers become graphite crystals. However, in all such conventional process, acrylic fibers which have been spun and then dried to be compacted are used as precursors. For example, as disclosed in Japanese Patent Publication No. 7889/1973, acrylic fibers as precursors for carbon fibers are produced by drying wet-spun fibers in a water-swollon state at a high temperature while passing the fibers at a high velocity through multistage rollers. However, in such conventional process, piles will be likely to be produced and the fibers tend to adhere on the rollers by static electricity which is generated as the filaments are dried while travelling. Therefore, not only the continuous operatability will be impaired but also the quality of fibers (precursors) to be carbonized and the physical properties of resulting carbon fibers will be reduced, and the industrialization of handling many fibers bundles has been remarkably obstructed. Therefore, in order to overcome these difficulties, it has been proposed to prevent the generation of static electricity by using an oil agent. However, such oil agent will become a tar or pitch at the time of heating the fibers, causing the obtained carbon fibers to stick or fuse together. The quality of the resulting carbon fibers is remarkably impaired thereby.

Further, it is known that the step condition required to compact (by drying) the wet-spum fibers is so complicated as to greatly reduce the operability. Therefore, in order to overcome such problem there has been suggested a process (Japanese Patent Publication No. 24185/1972) wherein acrylic fibers in a water-swollen state to be used as precursors for carbon fibers are simultaneously subjected to heating for compacting and also for thermal stabilization. Even with this process the above problem has not well dissolved. That is to say, in such process, as acrylic fibers in a water-swollen state are heated, the fibers will be necessarily fused with each other, many voids present within the fibers will not be able to be completely collapsed or eliminated, and therefore it will be difficult to obtain carbon fibers of a high quality. Further, the fibers are in a water-swollen state, the heating operation will be difficult. Further, in order to eliminate such voids in the fibers, it has been conventional to employ a method of simultaneously compacting and contracting the fibers. However, such operation will cause the reduction of the quality of particularly the Young's modulus of the resulting carbon fibers and is therefore undesirable as the step of producing acrylic fibers to be used as precursors for carbon fibers.

As a result of making researches to overcome such drawbacks, we have found that carbon fibers having a high quality can be industrially advantageously produced if acrylic fibers in a water-swollen state obtained by spinning an acrylonitrile homopolymer or copolymer by using an inorganic solvent are dried at a low temperature so as to reduce the water content in said fibers to be below a certain value and then the so dried fibers are heated.

A principal object of the present invention is to provide an improved process for producing carbon fibers.

A more particular object of the present invention is to industrially produce acrylic fibers, by the use of which the carbon fiber producing step can be remarkably simplified and improved and carbon fibers of a high quality can be stably and cheaply produced.

Another object of the present invention is to use, as precursors for the production of carbon fibers, acrylic fibers spun by using an inorganic solvent and dried in a water-swollen state at a low temperature to reduce the water content to be below a predetermined value so that the said fiber drying step is remarkably simplified, precursors having no pile can be provided and carbon fibers of high physical properties can be advantageously produced without fusing the fibers with each other in the heating step.

Other objects of the present invention will be apparent from the following description.

Such objects of the present invention are attained by drying at a temperature below 70° C. acrylic fibers in a water-swollen state of an orientation degree of at least 50% and a water-content of 5 to 150% spun from an inorganic solvent solution of an acrylonitrile homopolymer or copolymer containing at least 85 mol % acrylonitrile so as to reduce the water content in the fibers to be below 4% and then heating the so-dried fibers.

It is generally known that acrylic fibers are produced from an acrylonitrile homopolymer or copolymer by using an organic solvent such as dimethylformamide or dimethyl sulfoxide or an inorganic solvent such as a concentrated aqueous solution of nitric acid, zinc chloride or thiocyanate. However, it is recognized that, in such fiber producing step, if the drying and compacting operation is not sufficient, many voids will be produced within the fibers, so that the transparency of the fibers will be lost and a whitening or so-called devitrification will be caused. It has been considered that even if such devitrified acrylic fibers are high in the orientation degree, they will remarkably reduce in physical properties such as the strength during the thermal-stabilization step, so that they will not be able to sufficiently retain the practical and mechanical physical properties and will not be able to produce carbon fibers high in the strength and modulus of elasticity.

However, according to the researches made by the present inventors, it has been confirmed that, if a certain measure is taken, even such devitrified acrylic fibers will be able to provide carbon fibers of excellent physical properties. That is to say, when acrylic fibers are spun by using an inorganic solvent which is of a well known spinning process and then the obtained water-swollen fibers are dried at a low temperature under the above described conditions of the present invention, devitrified fibers will be obtained and will be able to provide carbon fibers of very excellent strength and modulus of elasticity without causing such troubles as the fusing and strength reduction during the heating step.

It is not yet clear why devitrified acrylic fibers suitable as precursors for the production of carbon fibers will be obtained only when an inorganic solvent is used. However, it is presumed that the voids in the fibers are remarkably finer and more uniform and are more likely to vanish when heated in the devitrified fibers obtained by using an inorganic solvent than in the case of using an organic solvent and that therefore the fibers can be fired or heated without impairing the mechanical physical properties of the fibers.

The acrylic fibers to be used in the present invention are fibers produced from an acrylonitrile homopolymer or copolymer containing at least 85 mol %, more preferably more than 90 mol % acrylonitrile. As comonomers to be copolymerized with acrylonitrile, there can be enumerated ethylenically unsaturated compounds such as allyl alcohol, methallyl alcohol, β-hydroxypropyl acrylonitrile, acrylic acid, methacrylic acid, itaconic acid, crotonic acid, methacrylonitrile, α-methyleneglutaronitrile, isopropenyl acetate, acrylamide, N-methylolacrylamide, β-hydroxyethyl methacrylate, dimethylaminoethyl methacrylate, vinylpyridine, vinylpyrrolidone, methyl acrylate, methyl methacrylate, vinyl acetate, acryl chloride, sodium methallylsulfonate and potassium p-styrenesulfonate. If there are used acrylic fibers produced from an acrylonitrile copolymer of an acrylonitrile content of less than 85 mol %, it will be possible to carry out the carbonizing firing step at a low temperature but the strength of the resulting carbon fibers will be so low that it will be difficult to produce carbon fibers having excellent properties.

For the production of acrylic fibers in a swollen state from such acrylonitrile homopolymer or copolymer, it is essential to use such well known inorganic solvent as a concentrated aqueous solution of an thiocyanate such as lithium thiocyanate, potassium thiosyanate, sodium thiocyanate or ammonium thiocyanate or inorganic salt such as zinc chloride or perchlorate or a concentrated aqueous solution of inorganic acid such as sulfuric acid or nitric acid. With any other organic solvent, the objects and effects of the present invention can not be attained. Particularly, by using as a solvent a concentrated aqueous solution of a thiocyanate, the voids in the low temperature dried fibers can be made very fine and therefore it is possible to obtain carbon fibers of a high modulus of elasticity and high strength without causing any trouble in the subsequent heating operation.

For spinning acrylic fibers from an acrylic polymer in such inorganic solvent, well known spinning process such as wet-spinning process can be employed. However it is preferable to employ a spinning process to be explained in the following. By this process water-swollen fibers according to the present invention can be more advantageously produced and, by using such fibers, it has become possible to produce carbon fibers of a higher strength and higher modulus of elasticity.

Thus, a spinning solution consisting of an acrylonitrile homopolymer or copolymer and its solvent is extruded into air or inert gas which is a noncoagulating gas for said spinning solution and is then led into a coagulating solution so as to be coagulated. More particularly, a spinning solution containing 5 to 30% by weight of an acrylonitrile homopolymer or copolymer and adjusted to be of a viscosity at 30° C. of $3 \times 10^4$ to $10^7$ centipoises is extruded into air or an inert gas (which is a noncoagulating gas for said spinning solution) through a spinnerette. The spinnerette is set at a distance of 0.2 to 15 cm. from the level of the coagulating bath and has spinning holes arranged at a space (the shortest distance between the outer peripheries of the adjacent spinning holes or orifices) of more than 1 mm. The fine streams of the extruded spinning solution are made to pass through the noncoagulating gas for the above mentioned distance and then are introduced into the coagulating bath consisting of water or a coagulating solution such as an aqueous solution of a concentration of less than about 20% of the above described inorganic salt or inorganic acid as a solvent so as to complete the coagulation.

The thus spun and coagulated filaments are water-washed in the usual manner as in producing acrylic fibers by an ordinary wet-spinning process and are then stretched usually about 3 to about 25 times, preferably 6 to 20 times the length. The thus obtained stretched fibers in a water-swollen state have many very fine voids. The acrylic fibers to be used in the present invention are those which are in a water-swollen state having an orientation degree of at least 50%, preferably more than 70% and of a water content [ = (water-swollen fiber weight - dry fiber weight) × 100/dry fiber weight] of 5 to 150%. If the orientation degree is less than 50%, no sufficient heating operation can be applied and therefore carbon fibers of high physical properties can not be obtained. Further, in case the water content is less than 5%, the fibers will be conventional compacted ones and will therefore cause such difficulties as described before. On the contrary, when the water-content is more than 150%, the water contained by the capillarity of the fibers will be retained as such and the drying efficiency will be low to the disadvantage of the industry. By the way, generally, water-swollen acrylic fibers of such water content can be produced directly by the above described spinning process or, as required, by removing excess water. Even in the case that the spun fibers are partly compacted or that they are once compacted and are then re-swollen by a high pressure saturated stream treatment, they can be used in this invention if they are water-swollen fibers in the above mentioned range of the water content.

The water-swollen acrylic fibers having such specific water content are then dried under a temperature condition below 70° C., preferably below 60° C. according to the present invention until the water-content is reduced to be below 4%, preferably below 2%. The thus dried fibers are used as precursors for the production of carbon fibers according to this invention.

The method of drying the water-swollen fibers at a low temperature according to the present invention is not specifically limited to a particular one and any known conventional drying method can be used. For example, there is preferably used a method wherein water-swollen fibers are wound up in the form of a hank or on a bobbin and are dried batchwise or continuously by Nelson rollers or the like. In such case, the fibers will be dried while allowing a fiber length holding rate in a range of 90 to 110% or preferably 94 to 102% in an atmosphere of a humidity of 5 to 90%, preferably 10 to 50%. The lower limit of the temperature for drying is not specifically defined and any known freeze-drying method may well be used but it is desirable to employ a drying temperature generally above 0° C. It may be said to be one of the features of the present invention even from the viewpoint of saving energy that particularly, in continuously heating acrylic fibers, said fibers are fed to a heating furnace slowly so that there can be adopted a method wherein water-swollen fibers are exposed in a room temperature air atmosphere or drying atmosphere for several minutes to several hours and are then fed to the furnace.

When the drying temperature exceeds 70° C., the properties as of precursors of the dried fibers will be reduced and the objects of the present invention will not be able to be well attained.

When the water content in the dried fibers exceeds 4%, such trouble as fusing will be caused at the time of heating and carbon fibers of a high quality will not be obtained.

In producing carbon fibers from the thus obtained low temperature dried acrylic fibers, any known conventional heating or firing process can be employed. However, generally it is preferable to employ a process consisting of a primary heating step (so-called thermal stabilization step) wherein the fibers are heated to 150° to 400° C. in an oxidizing atmosphere so as to be cyclized (so that cyclized structure of polynaphtyridine ring is formed in the fiber) and a secondary step wherein the fibers are further heated at a high temperature (usually above 800° C.) in a non-oxidizing atmosphere or under a reduced pressure so as to be carbonized or carbonized and graphitized.

For the atmosphere to be used in the thermal-stabilization step, air is preferable but there can be employed another process wherein the fibers are heated for thermal-stabilization in the presence of sulfur dioxide or nitrogen monoxide gas or under the radiation of rays. Further, for the carbonizing temperature, there is generally used a temperature of 800° to 2000° C. In order to further graphitize the obtained carbon fibers, there is generally used a temperature of 2000° to 3500° C. For the atmosphere to be used in the carbonization or graphitization step, there is preferably used nitrogen, hydrogen, helium or argon. Further, for producing carbon fibers of a higher strength and modulus of elasticity, it is preferable, as generally known, to heat them under a tension. It is particularly effective to apply a tension at the time of the thermal-stabilization step and carbonization or graphitization step. The carbonization or graphitization may be carried out under a reduced or increased pressure.

Thus, in the present invention, acrylic fibers in a water-swollen state are taken from a fiber producing step, are dried at a low temperature and are then heated. Therefore any oil treatment can be omitted, there is substantially no such generation of piles as in the case of high temperature drying, there can be eliminated all such troubles as fusing of heated fibers seen in the case of using swollen fibers directly as precursors. Therefore carbon fibers very excellent in the strength and modulus of elasticity can be produced at a high productivity. Particularly, if the low temperature drying operation according to the present invention can be carried out by exposing the fibers in a room temperature atmosphere for a fixed time by taking into consideration the velocity of feeding the fibers into the heating furnace and then the dried fibers can be immediately introduced into the heating furnace, the process will be very advantageous not only to saving energy but also to the industrial operatability of the production of carbon fibers.

The invention will be explained by means of the following typical examples in which the percentages and parts are by weight unless otherwise specified.

EXAMPLE 1

A monomer mixture consisting of 98 mol % acrylonitrile and 2 mol % methacrylic acid was polymerized by an aqueous precipitation polymerization process with the use of an ammonium persulfate/sodium sulfite type polymerization initiator to obtain an acrylonitrile copolymer. Then a spinning solution obtained by dissolving 12 parts of such acrylonitrile copolymer in 88 parts of a 50% aqueous solution of sodium thiocyanate was extruded into air through a spinnerette of 204 orifices (orifice diameter 0.15 mm.) and passed through air for a distance of 0.5 cm. and was then led into a coagulating bath consisting of a 13% aqueous solution of sodium thiocyanate at 2° C. Then the obtained filaments were water-washed and were then stretched 5 times the length in boiling water and 2.2 times the length in superheated steam to obtain acrylic fibers in a water-swollen state having a water content of 90% and orientation degree of 82%.

The thus obtained swollen fibers were dried by being left in air of a humidity of 30% and temperature of 18° C. for 5 minutes to 5 hours while being kept under a fixed length to make four kinds (A to D) of dried fibers of water contents respectively of less than 0.1%, 3%, 18% and 30%. By the way, all these dried fibers were devitrified and showed milk white.

Then these four kinds of acrylic fibers were heated in an ordinary manner to obtain four kinds of carbon fibers. Thus, for heating, there was employed a process wherein the temperature was continuously elevated at a rate of 2° C./min. from 200° to 300° C. while maintaining the fibers at a fixed length in an air atmosphere to obtain thermally stabilized fibers and further these thermally stabilized fibers were heated under a fixed length at a temperature elevating rate of 5° C./min. from 200° to 1100° C. in a nitrogen gas atmosphere so as to be carbonized. Further, for comparison the same heating operation was conducted in respect of the above described water-swollen fibers (E) having a water content of 90% (without being dried).

The various physical properties of the thus obtained carbon fibers were measured. The results are shown in Table 1. As evident from Table 1, when acrylic fibers having had the water content reduced to be below 4% by being dried at a low temperature according to the present invention were used as precursors, the fusing at the time of having could be prevented and the strength and modulus of elasticity of the resulting carbon fibers could be remarkably improved.

Table 1

| Sample | Water content before heating (%) | Properties of carbon fibers: Strength (kg./mm²) | Modulus of elasticity (tons/mm²) | Elongation (%) | Appearance |
|---|---|---|---|---|---|
| A | 0.1 | 284 | 23.9 | 1.0 | Not fused |
| B | 3 | 260 | 23.0 | 1.0 | Slightly fused |
| C | 18 | 217 | 19.5 | 1.0 | Fused |
| D | 30 | 185 | 19.0 | 0.9 | |
| E | 90 | The fusing was so remarkable that the measurement was impossible. | | | |

EXAMPLE 2

A spinning solution was prepared in the same manner as in Example 1 except that an acrylonitrile copolymer consisting of 97 mol % acrylonitrile and 3 mol % methyl acrylate was used. The spinning solution was extruded into air through a spinnerette of 100 orifices (orifice diameter 0.15 mm.) and was made to run for a distance of 0.8 cm., was then introduced into a coagulating bath consisting of a 13% aqueous solution of sodium thiocyanate at 2° C. The coagulated fibers were water-washed and then stretched 6 times the length in boiling water and then 2 times the length in superheated steam to obtain acrylic fibers in a water-swollen state having a water-content of 110% and orientation degree of 79%.

The thus obtained swollen fibers were wound up on a bobbin (outside diameter 10 cm.) made of aluminum and were then dried respectively at temperatures of 30, 50, 70, 90° and 110° C. until the water content became 0.1% while maintaining the length at 100% to make five kinds of dried fibers (F to J).

Then the obtained five kinds of acrylic fibers were respectively thermally stabilized by elevating the temperature at a rate of 1° C. per minute from 200° to 300° C. while keeping a tension of 0.06 g./d. in an air atmosphere and were then further heated to 1200° C. while allowing a contraction of 2% in a nitrogen atmosphere to obtain various carbon fibers having characteristic values shown in Table 2.

As apparent from the results shown in Table 2, it will be understood that the adoption of a drying temperature exceeding 70° C. will cause piling of carbon fibers and will remarkably reduce the physical properties of the carbon fibers and that the generation of the slightest piles will have a remarkably bad influence on the physical properties of the carbon fibers.

Table 2

| | Dry conditions | | Properties of carbon fibers | | |
|---|---|---|---|---|---|
| Sample | Temperature (° C.) | Humidity (%) | Strength (kg./mm²) | Modulus of elasticity (tons/mm²) | Appearance |
| F | 30 | 23 | 277 | 23.6 | No pile |
| G | 50 | 13 | 281 | 24.1 | " |
| H | 70 | 27 | 256 | 23.1 | No pile |
| I | 90 | 25 | 188 | 21.2 | Piles partly recognized |
| J | 110 | 14 | 105 | 17.1 | Many piles recognized |

EXAMPLE 3

The water-swollen acrylic fibers of a water content of 110% wound up on the bobbin in Example 2 were fed at a velocity of 3 cm./min. to Nelson rollers in an atmosphere of a temperature of 22° C. and humidity of 45% and were made to stay for about 60 minutes so as to be dried to a water content of 1.6%. Then the dried fibers were immediately fed at the same feeding velocity into a heating furnace of a length of 1090 mm., had then the temperature continously elevated from 195° to 304° C. in an air atmosphere in said heating furnace so as to be thermally stabilized. Then the fibers were heated to 1200° C. in a nitrogen atmosphere to obtain carbon fibers having excellent physical properties such as a strength of 295 kg./mm² and modulus of elasticity of 24.6 tons/mm².

EXAMPLE 4

An acrylonitrile copolymer consisting of 96 mol % acrylonitrile, 2 mol % acrylic acid and 2 mol % methyl acrylate was spun in the same manner as in Example 1 to obtain acrylic fibers in a water-swollen state having a water content of 100%. Then these swollen fibers were exposed for about 1 hour in air of a temperature of 50° C. and humidity of 10% under a fixed length to obtain devitrified dried fibers having a water content of less than 0.1%.

The thus obtained devitrified dried fibers were continuously heated at a temperature elevating rate of 1° c./min. from 200° to 290° C. in a fixed length state in an air atmosphere so as to be thermally stabilized. Then these thermally stabilized fibers were heated to 1100° C. under a fixed length at a temperature elevating rate of 10° C./min. from 200° C. in a nitrogen atmosphere to obtain carbon fibers having a strength of 250 kg./mm², modulus of elasticity of 23 tons/mm² and elongation of 1.1%.

What is claimed is:

1. In a process for producing carbon fibers which comprises spinning acrylic fibers from an inorganic solvent solution of an acrylonitrile homopolymer or copolymer containing at least 85 mol percent acrylonitrile, drying the fibers and subsequently heating to obtain carbon fibers, the improvement according to which the spun fibers are water-washed and stretched from about 3 to about 25 times their length to obtain acrylic fibers in a water-swollen state having an orientation degree of at least 50 percent and a water content of from 5 to 150 percent, drying the said fibers at a temperature below 70° C to reduce the water content therein to below 4 percent and subsequently heating the fibers to obtain carbon fibers.

2. A process according to claim 1 wherein the spun fibers are obtained by spinning a spinning solution consisting of an acrylonitrile homopolymer or copolymer and its solvent into air or inert gas which is a non-coagulating gas for said spinning solution and then leading the fibers into a coagulating bath.

3. A process according to claim 1 wherein said acrylic fibers in a water-swollen state are dried at a temperature below 60° C.

4. A process according to claim 1 wherein the temperature for drying is 0° to 70° C.

5. A process according to claim 1 wherein said acrylic fibers in a water-swollen state are dried to be of a water content of less than 2%.

6. A process according to claim 1 wherein said inorganic solvent is a concentrated aqueous solution of a thiocyanate.

7. A process according to claim 1 wherein said acrylonitrile copolymer contains at least 90 mol % acrylonitrile.

8. A process according to claim 1 wherein said dried acrylic fibers are thermally stabilized by being heated in an oxidizing atmosphere at a temperature of 150° to 400° C. and are then carbonized in a non-oxidizing atmosphere at a temperature of 800° to 2000° C.

9. A process according to claim 8 wherein said oxidizing atmosphere is air.

10. A process according to claim 8 wherein said nonoxidizing atmosphere is nitrogen.

11. A process according to claim 8 wherein said thermally stabilized fibers are carbonized in a non-oxidizing atmosphere at a temperature of 800° to 2000° C. and are then graphitized in a non-oxidizing atmosphere at a temperature of 2000° to 3500° C.

12. A process according to claim 2 wherein the distance between the under surface of the spinnerette and the surface of the coagulating bath is 0.2 to 15 cm.

13. A process according to claim 1 wherein the stretching ratio is 6 to 20 times.

14. An improved carbon fiber produced in accordance with the process of claim 1.

* * * * *